US012686979B2

(12) United States Patent
Wouters

(10) Patent No.: US 12,686,979 B2
(45) Date of Patent: Jul. 21, 2026

(54) PEDESTRIAN PROTECTIVE BARRIER

(71) Applicant: Marc Wouters, Brooklyn, NY (US)

(72) Inventor: Marc Wouters, Brooklyn, NY (US)

( * ) Notice: Subject to any disclaimer, the term of this patent is extended or adjusted under 35 U.S.C. 154(b) by 418 days.

(21) Appl. No.: 18/178,627

(22) Filed: Mar. 6, 2023

(65) Prior Publication Data

US 2023/0279625 A1 Sep. 7, 2023

Related U.S. Application Data

(60) Provisional application No. 63/317,169, filed on Mar. 7, 2022.

(51) Int. Cl.
*E01F 13/02* (2006.01)

(52) U.S. Cl.
CPC ..... *E01F 13/022* (2013.01)

(58) Field of Classification Search
CPC .. E01F 13/022; E01F 15/088; E04H 17/1404; A01G 9/027
See application file for complete search history.

(56) References Cited

U.S. PATENT DOCUMENTS 3,906,665 A * 9/1975 Medlin ..... A01G 9/027 52/590.1
4,059,362 A * 11/1977 Smith ..... E01F 15/088 404/6
5,154,032 A * 10/1992 Ritter ..... E04C 1/395 47/33
5,387,049 A * 2/1995 Duckett ..... E01F 15/088 404/6
7,168,218 B2 * 1/2007 Spratlen ..... E04C 5/02 52/604
2004/0076468 A1 * 4/2004 Mckay ..... E01F 15/088 404/6
2012/0090234 A1 * 4/2012 Cronin ..... A01G 9/025 52/576
2018/0265252 A1 * 9/2018 Diep ..... B65D 21/0233
2022/0369571 A1 * 11/2022 Pointek ..... B65D 25/08

FOREIGN PATENT DOCUMENTS

FR 2786211 B1 * 4/2003 ..... E01F 15/10
KR 200410344 Y1 * 12/2005 ..... E01F 15/00

* cited by examiner

*Primary Examiner* — Michael P Ferguson
(74) *Attorney, Agent, or Firm* — Tatonetti IP

(57) ABSTRACT

A pedestrian protective barrier includes a base barrier and a removable lid that engages with and covers the base barrier. The protective barrier may be made from a resin, plastic, or other suitable material that satisfies the properties and features herein. By using plastic or resin, for example, the protective barrier is sufficiently light to enable easy storage and transportation. The base barrier includes an interior cavity to receive and accommodate a weighted material, such as water, dirt, sand, weights, etc., once the protective barriers are arranged in a desired place, such as in the street protecting a restaurant's dining area, each base barrier's cavity may be filled with a desired weighted material.

8 Claims, 6 Drawing Sheets

PEDESTRIAN PROTECTIVE BARRIER

CROSS-REFERENCES TO RELATED APPLICATIONS

This Non-Provisional Utility patent application claims the benefit of and priority to U.S. Provisional Patent Application Ser. No. 63/317,169, filed Mar. 7, 2022, entitled "Pedestrian Protection Barrier," the entire contents of which is hereby incorporated herein by reference.

BACKGROUND

Existing roadway barriers that protect pedestrians from traffic tend to be difficult to move, store, and transport. For example, barriers tend to require dismantling before a user can pack up and relocate them.

Low wood walls filled with sandbags are the most commonly used barriers for outdoor dining in curb lanes and meet the material weight requirements established by local authorities. However, these wood wall barriers cannot be moved unless destroyed and are too large for storage. Large stone and concrete block barriers require large machinery to move them.

SUMMARY

A pedestrian protective barrier is adapted with a base barrier and a removable lid that engages with and covers the base barrier. The protective barrier may be made from a resin, plastic, or other suitable material that satisfies the properties and features described herein. By using plastic or resin, for example, the protective barrier is sufficiently light to enable easy storage and transportation.

The base barrier includes an interior cavity to receive and accommodate a weighted material, such as water, dirt, sand, weights, etc., once the protective barriers are arranged in a desired place, such as in the street protecting a restaurant's dining area. In this regard, multiple protective barriers may be linearly arranged and engaged with each other so that there is no opening in the protection. The base barrier and lid may be designed with geometries so that adjacently positioned protective barriers engage with each other, providing a more secure barrier and preventing the barriers from moving inadvertently. For example, in some implementations, the protective barrier's front side may taper to a point, and its rear side may taper inward to accommodate a front's point. Other geometries are also possible, such as angles, curvilinear, etc.

The lid is removable and rests on a top of the base barrier's rim. The lid's top surface may have a depressed cavity to accommodate various decorations. For example, a restaurant owner may fill the lid's cavity with dirt, flowers, or other decorations. The base barrier's rim includes a stop on which a bottom of the lid's rim engages and rests. The base barriers are stackable, so multiple can be stacked into each other. This provides overall easier and more compact storage and transportability. Given the relatively light weight of the barriers, a user can easily remove one or more base barriers from the stacked arrangement.

This Summary is provided to introduce a selection of concepts in a simplified form that is further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from reading the following Detailed Description and reviewing the associated drawings.

BRIEF DESCRIPTION OF THE DRAWINGS

Like reference numerals indicate like elements in the drawings. Elements are not drawn to scale unless otherwise indicated.

DETAILED DESCRIPTION

Figure 1:
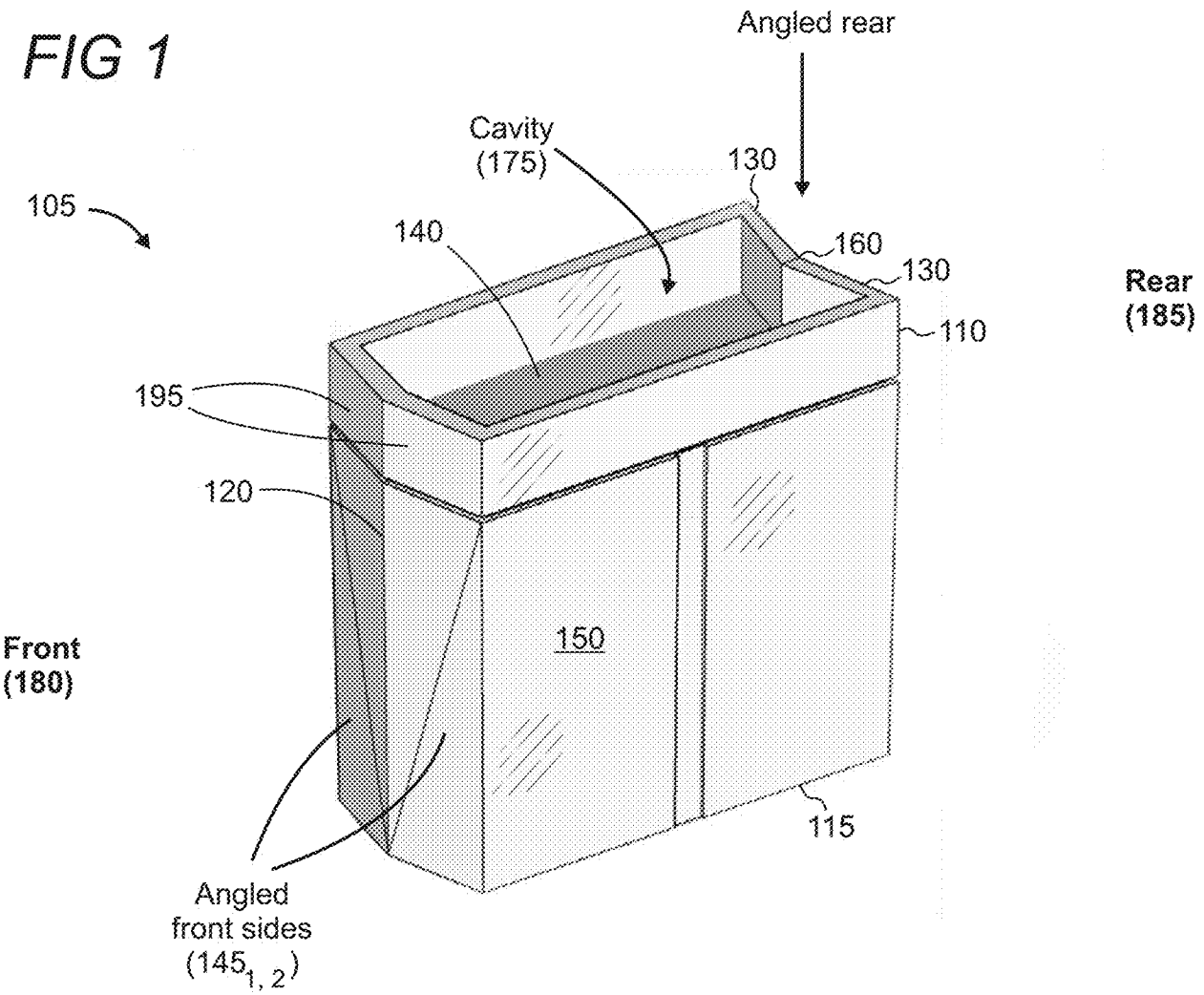
FIG. 1 shows an illustrative perspective representation of a pedestrian protective barrier having a base barrier and associated lid.

FIG. 1 shows an illustrative representation in which a pedestrian protection barrier 105 is configured with base barrier 115 and a lid 110 that engages with the base barrier. The protective barrier may be constructed from resin, plastic, 3D printed materials, among other materials that enable the protective barrier to satisfy the features described herein. The base barrier and lid have a front side 180 that angles outward to a point 120 and a rear side 185 that forms an indent toward a point 160 which is meant to accommodate another protective barrier's front side. Thus, for example, the barriers angled front sides 145 (for the base barrier) and 195 (for the lid) may engage with another barrier's angled rear sides 130 (base barrier's rear angled sides unshown in FIG. 1). This way, multiple protective barriers 105 can be linearly arranged and combined to protect a given area, and the engagement can help prevent the barriers from inadvertently moving. In between the front and rear sides of the protective barrier are sides 150.

The protective barrier's lid 110 has a top cavity 175 to allow users to store items therein, such as decorative materials like flowers and other gardening decorations. The user may place dirt on top of the lid's base 140 and then plant flowers therein.

Figure 2:
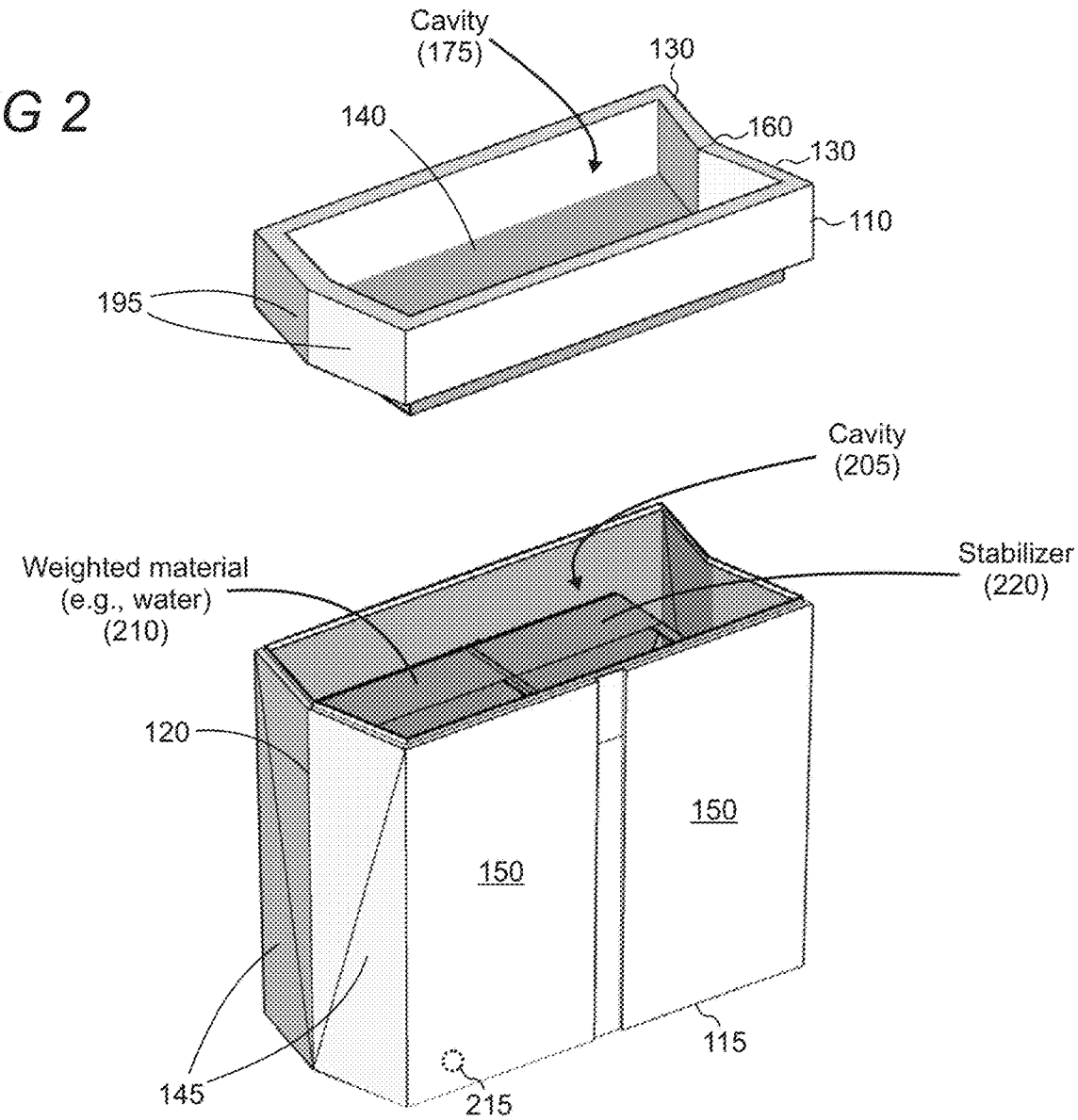
FIG. 2 shows an illustrative representation in which the lid is lifted from the base barrier.

FIG. 2 shows an illustrative representation in which the lid 110 is lifted from the base barrier 115. A perimeter of the lid may engage with and rest on the top perimeter of the base barrier's rim. The lid's cavity 175 and base 140 may be depressed to at least partially enter the base barrier's interior cavity 205.

The base barrier's interior cavity 205 can be filled with some weighted material 210 to provide girth to the protective barrier. When the lid is not engaged, the base barrier's top side is completely open to provide unobstructed access to the interior cavity. Exemplary weighted material can include water, dirt, sand, etc. When constructed, the protective barriers may be empty to enable easy storage and transportability. Once the barrier reaches its intended destination, such as at a restaurant having outdoor dining, the barriers can be linearly arranged surrounding the outdoor dining area and then filled with, for example, water. For disassembly, the water or dirt may be emptied from the top of the base barrier 115. Alternatively, in some implementations, a closeable spigot or opening 215 may be positioned toward the bottom of the base barrier to enable a user to easily and effortlessly empty the contents, such as sand or water. Other weighted materials may also be used, such as actual weights or other materials that may be required to satisfy some local law.

As shown in FIG. 2, a removable inner stabilizer may also be used when certain types of filling materials are used. The stabilizer may be attached to the base barrier's interior surfaces to stabilize the weighted materials and the barrier. The stabilizer may be made of various materials, including plastic, resin, metal, etc. The protective barrier may use screws, bolts, or other fastener that attaches the stabilizer to its surface. For example, one or more pieces of rope may be tied around the stabilizer which is then fastened to the base barrier's interior walls.

Figure 5:
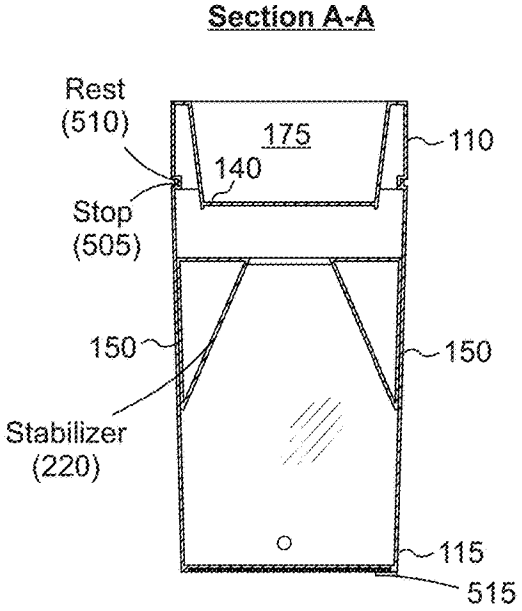
FIG. 5 shows an illustrative cross-sectional A-A view from FIGS. 3 and 4.
Figure 3:
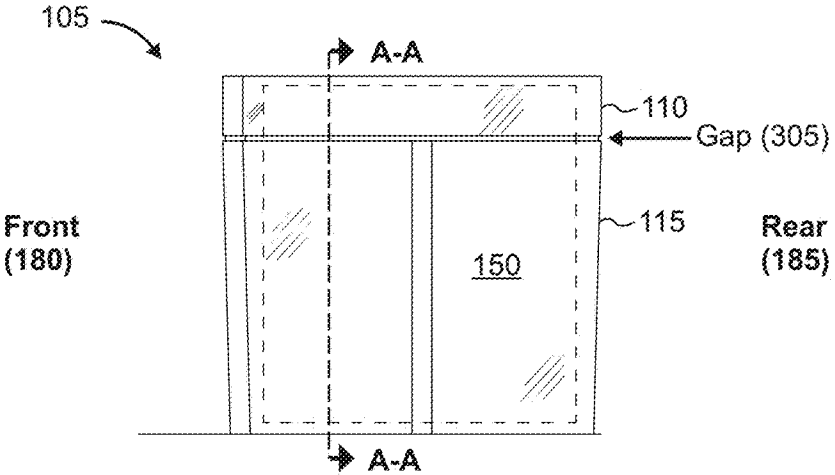
FIGS. 3 and 4 show illustrative schematic representations of the pedestrian protective barrier.
Figure 4:
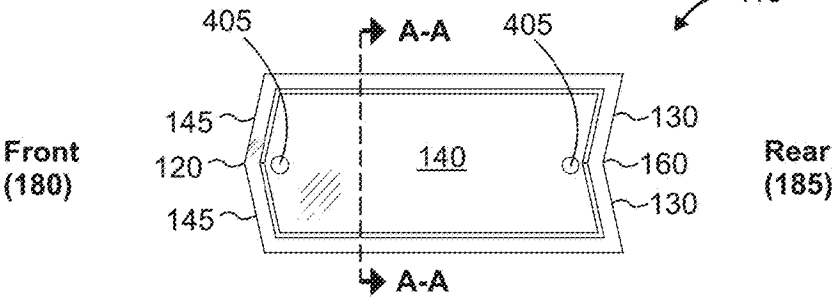

FIGS. 3-5 show illustrative representations of the pedestrian protective barrier 105 from various angles. FIG. 3, for example, shows the protective barrier from a side 150. When the lid 110 is engaged with the base barrier 115, a gap 305 may be present as the portion on the base barrier that the lid rests on is positioned on an interior side (FIG. 2). The side surfaces 150 of the base barrier may have an articulated surface with multiple options for decorative texture so restaurants can customize the barrier's aesthetics. FIG. 4 shows a top view of the lid 110, which shows holes 405 that can be used for holding respective poles. For example, a restaurant may use the hole to insert a pole holding a light or signage. The holes may be placed at various locations throughout the lid, and the holes shown are exemplary only.

FIG. 5 shows a cross-sectional of section A-A shown in FIGS. 3 and 4. As shown, the base barrier 115 includes a stop 505 positioned on the interior side of its top rim, with which a corresponding rest 510 on the lid engages. The lid's base 140 and cavity 175 slightly enters the base barrier's interior cavity when the lid rests on the base barrier's rim. Furthermore, the bottom of the base barrier includes an attachment 515 that accepts shims for leveling of the base barrier. Since the protective barriers 105 are typically placed on streets that often have an uneven surface, the attachment can allow users to stick a shim or other like to make the barrier even. The shim may be premanufactured to fit within the attachment on the base barrier, it may be made from a plastic, resin, metal, etc. The shim attachment shaped to have a grove or preinstalled screw type hole that allows premanufactured shims to be secured to the base of the barrier through either use of a screw or a tough and grove slot configuration.

Figure 6:
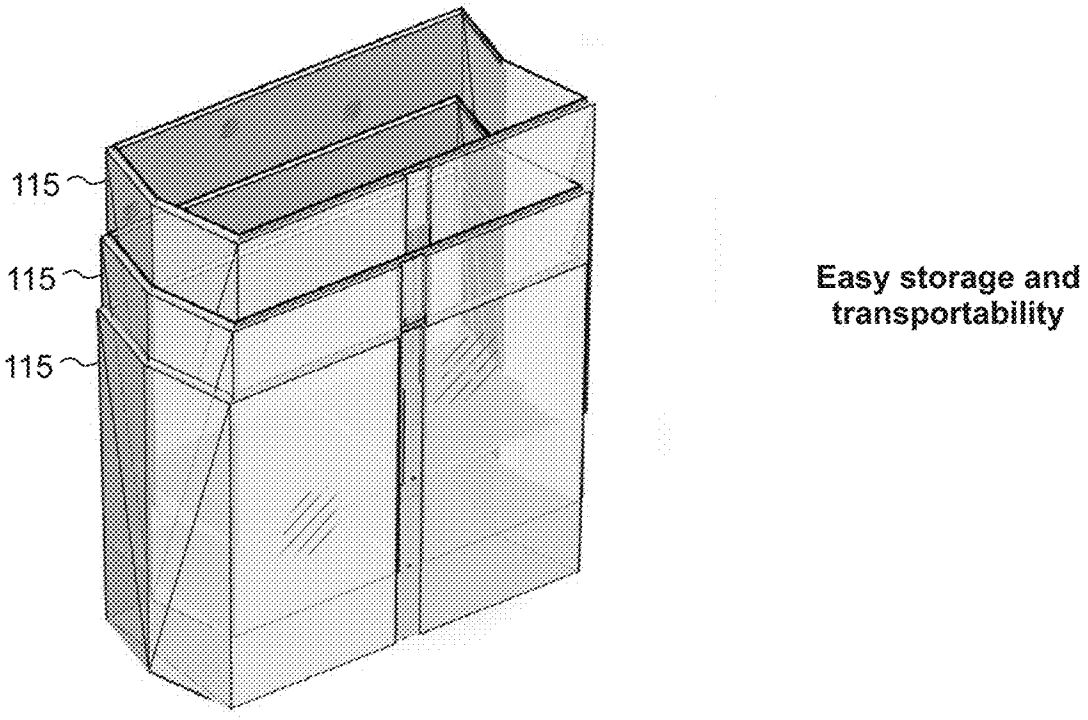
FIG. 6 shows an illustrative representation of stacked base barriers for convenient storage and transportability.

FIG. 6 shows an illustrative representation in which multiple base barriers 115 are stacked into each other to enable easy storage and transportability. While only three base barriers are shown, any number of base barriers are stackable. As the protective barriers 105 may be constructed from a relatively lighter material such as resin, plastic, etc., a user should be able to relatively easily stack and unstack the base barriers.

Figure 7:
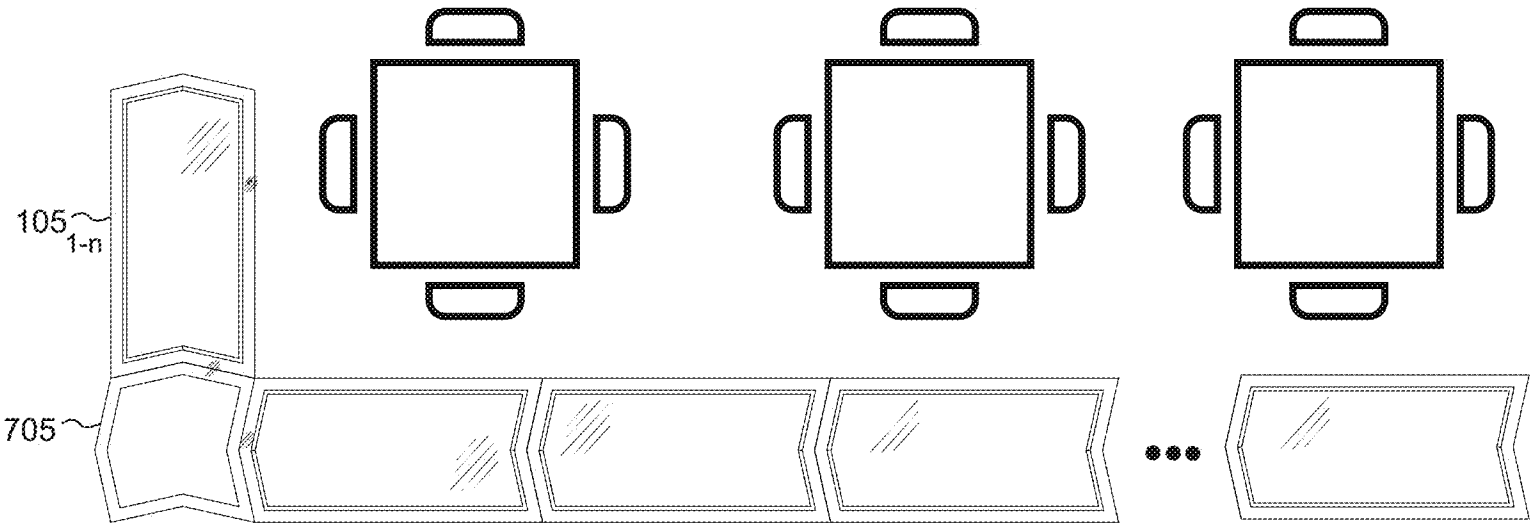
FIG. 7 shows an illustrative representation in which a series of pedestrian protective barriers are laterally engaged.

FIG. 7 shows an illustrative representation in which multiple pedestrian protective barriers 105 are linearly arranged and set up. As shown, the front angle of each barrier 105 dovetails into the correspondingly shaped rear side of the barrier in its front. This enables each barrier to be more secure in place since each barrier is trapped on both of its ends. FIG. 7 also shows a corner module 705 specifically crafted and designed for the current protective barrier design. For example, the corner module's shape corresponds to both the front and rear sides of the barriers to enable a secure connection thereto. As shown, two sides form an outward tapered point to engage with a rear end of a protective barrier, and the two other sides form an inward tapered point to engage with the rear side of a protective barrier. The corner module may be made of a similar material to the protective barriers, such as resin, plastic, etc.

Figure 8A:
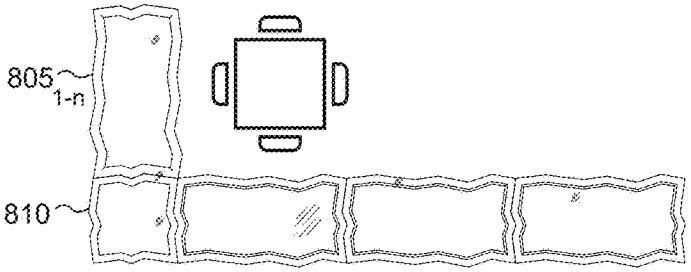
FIGS. 8A-C show various illustrative representations of alternative protective barrier designs.
Figure 8B:
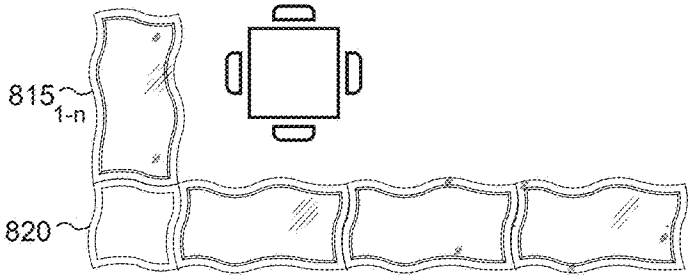
Figure 8C:
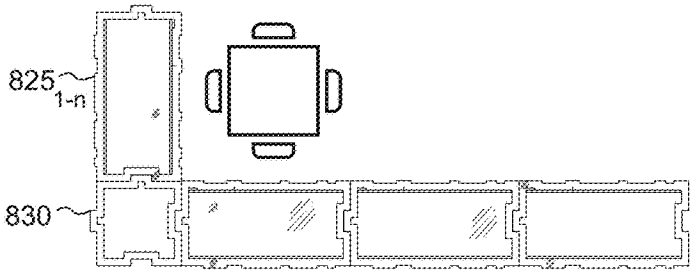

FIGS. 8A-C show various illustrative representations of design alternatives of the protective barrier 105. For example, instead of the front and rear sides of the protective barrier forming corresponding points, one or more sides of the protective barriers may form a zig-zag, a curvilinear, and stepped geometries, as respectively shown by reference numerals 805, 815, and 825. When constructed with different geometries, corresponding geometries on adjacently positioned protective barriers are configured to fit like a puzzle. This ensures that the barriers are secured and maintain their position, thereby preventing inadvertent moving. As shown, each corner module 810, 820, and 830 would be designed with a similar design so the corner module can securely engage with adjacent protective barriers.

Various embodiments of a protective barrier are described herein. One exemplary embodiment describes a pedestrian protective barrier comprising: a base barrier having an interior cavity, in which the base barrier's top side is entirely open and leads to the interior cavity, wherein a rear side of the base barrier has a shape that accommodates a shape of the base barrier's front side; and a lid that is separate from the base barrier and rests on a top side rim of the base barrier.

In another example, an overall shape of the lid corresponds to a shape of the base barrier. As another example, the lid includes a depressed cavity on its top surface. As another example, at least a portion of the lid's depressed cavity enters the base barrier's interior cavity. As a further example, the base barrier's front side tapers to form an outward point, and the rear side tapers to form an inward point that accommodates the front side's outward point. In another example, further comprising a second pedestrian protective barrier, wherein a front side point of the second pedestrian protective barrier engages with the inward point on the rear side of the pedestrian protective barrier. As another example, further comprising a corner module that has at least one side that matches a shape of the pedestrian protective barrier's front side, and the corner module further having at least one side that matches a shape of the pedestrian protective barrier's rear side. In another example, a base surface of the lid's depressed cavity includes a hole.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A pedestrian protective barrier, comprising:

a base barrier having a pair of opposing front and rear exterior sidewalls and a pair of opposing left and right exterior sidewalls therebetween defining an interior cavity, in which the base barrier's top side is entirely open and leads to the interior cavity, wherein an entirety of the rear exterior sidewall of the base barrier corresponds in size and to an entirety of the base barrier's front exterior sidewall, and the front and rear exterior sidewalls of the base barrier are correspondingly angled such that the front exterior sidewall matingly engages with the rear exterior sidewall of another said base barrier; and a lid that is separate from the base barrier and rests on a top side rim of the base barrier, the lid including a pair of opposing front and rear exterior sidewalls and a pair of opposing left and right exterior sidewalls therebetween, wherein the lid includes a depressed cavity on its top surface, and at least a portion of the lid's depressed cavity enters the base barrier's interior cavity, in which the lid's depressed cavity's vertical area forms a different size than the base barrier's interior cavity's vertical area, wherein an entirety of the lid's front exterior sidewall corresponds in size and shape to the lid's rear exterior sidewall, and the front and rear exterior sidewalls of the lid are correspondingly angled such that front exterior sidewall matingly engages with the rear exterior sidewall of another said lid; and wherein, when the lid is rested on the top side rim of the base barrier, the lid's exterior front sidewall and the base barrier's exterior front sidewall correspondingly mate with exterior rear sidewalls of the lid and base barrier of another said pedestrian protective barrier, respectively.

2. The pedestrian protective barrier of claim 1, wherein an overall shape of the lid corresponds to a shape of the base barrier.

3. The pedestrian protective barrier of claim 1, wherein the base barrier's front sidewall tapers to form an outward point, and the rear sidewall tapers to form an inward point that accommodates the front sidewall's outward point.

4. The pedestrian protective barrier of claim 3, further comprising a second said pedestrian protective barrier, wherein the front sidewall point of the second pedestrian protective barrier engages with the inward point on the rear sidewall of the pedestrian protective barrier.

5. The pedestrian protective barrier of claim 4, further comprising a corner module that has at least one sidewall that matches a shape of the pedestrian protective barrier's front sidewall, and the corner module further having at least one sidewall that matches a shape of the pedestrian protective barrier's rear sidewall.

6. The pedestrian protective barrier of claim 1, wherein a base surface of the lid's depressed cavity includes a hole.

7. The pedestrian protective barrier of claim 1, wherein at least one of the base barrier's left and right sidewalls is shaped to correspond to an adjacently positioned left or right sidewall on a separate second said base barrier.

8. The pedestrian protective barrier of claim 1, wherein, when the lid is rested on the top side rim of the base barrier, a base of the lid's depressed cavity is positioned within the base barrier's interior cavity, while a top of the lid is positioned above a top surface of the base barrier.

* * * * *